US008477157B2

(12) United States Patent
Otawara

(10) Patent No.: US 8,477,157 B2
(45) Date of Patent: Jul. 2, 2013

(54) APPARATUS FOR PROCESSING IMAGE SIGNAL, PROGRAM, AND APPARATUS FOR DISPLAYING IMAGE SIGNAL

(75) Inventor: Masayuki Otawara, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 1006 days.

(21) Appl. No.: 12/512,509

(22) Filed: Jul. 30, 2009

(65) Prior Publication Data

US 2010/0026732 A1 Feb. 4, 2010

(30) Foreign Application Priority Data

Aug. 1, 2008 (JP) ..... 2008-199615

(51) Int. Cl.
*G09G 5/10* (2006.01)

(52) U.S. Cl.
USPC ..... 345/690; 345/89; 358/461

(58) Field of Classification Search
USPC ..... 345/76–83, 88, 89, 690; 358/461, 358/518
See application file for complete search history.

(56) References Cited

U.S. PATENT DOCUMENTS

| | | | | |
|---|---|---|---|---|
| 7,623,108 | B2 * | 11/2009 | Jo et al. | 345/98 |
| 8,184,224 | B2 * | 5/2012 | Asano et al. | 349/43 |
| 2002/0067324 | A1 | 6/2002 | Aoki | |
| 2003/0201955 | A1 | 10/2003 | Song et al. | |
| 2005/0052364 | A1 | 3/2005 | Otawara et al. | |
| 2005/0280615 | A1 | 12/2005 | Cok et al. | |
| 2006/0092329 | A1 * | 5/2006 | Noji | 348/607 |
| 2008/0062155 | A1 | 3/2008 | Wang et al. | |
| 2008/0100542 | A1 | 5/2008 | Miller et al. | |
| 2009/0225072 | A1 | 9/2009 | Mizukoshi et al. | |

FOREIGN PATENT DOCUMENTS

| | | | |
|---|---|---|---|
| JP | 9-134145 | A | 5/1997 |
| JP | 2002-229530 | A | 8/2002 |
| JP | 2003-280590 | A | 10/2003 |
| JP | 2005-62337 | A | 3/2005 |
| JP | 2005-62382 | A | 3/2005 |
| JP | 2006-163074 | A | 6/2006 |
| JP | 2008-40124 | A | 2/2008 |
| JP | 2008-145880 | A | 6/2008 |
| JP | 2009-216801 | A | 9/2009 |

(Continued)

OTHER PUBLICATIONS

European Search Report dated May 3, 2010 from the European Patent Office in a counterpart application EP 09166263.5.
Communication dated Oct. 23, 2012, issued by the Japanese Patent Office in counterpart Japanese Patent Application No. 2008-199615.

*Primary Examiner* — Kimnhung Nguyen
(74) *Attorney, Agent, or Firm* — Sughrue Mion, PLLC

(57) ABSTRACT

Provided are an apparatus and method for processing an image signal. The apparatus includes a first correction value derivation unit deriving a first correction value for correcting an input image signal for each pixel of a line in a horizontal direction based on the input image signal, a second correction derivation unit deriving a second correction value for correcting the input image signal for each pixel of a line in a vertical direction based on the input image signal, a third correction value derivation unit deriving a third correction value for correcting the input image signal for each pixel forming a display screen which displays an image, based on the first correction value and the second correction value, and a signal correction unit correcting the input image signal based on the third correction value.

10 Claims, 13 Drawing Sheets

FOREIGN PATENT DOCUMENTS

| | | | |
|---|---|---|---|
| JP | 2010-508559 | A | 3/2010 |
| WO | 2005/088593 | A1 | 9/2005 |
| WO | 2005/122120 | A2 | 12/2005 |

* cited by examiner

APPARATUS FOR PROCESSING IMAGE SIGNAL, PROGRAM, AND APPARATUS FOR DISPLAYING IMAGE SIGNAL

CROSS-REFERENCE TO RELATED PATENT APPLICATION

This application claims priority from Japanese Patent Application No. 2008-199615, filed on Aug. 1, 2008, in the Japanese Intellectual Property Office, the disclosure of which is incorporated herein in its entirety by reference.

BACKGROUND OF THE INVENTION

1. Field of the Invention

Apparatuses and methods consistent with the present invention relate to processing an image signal and displaying an image signal.

2. Description of the Related Art

Recently, various kinds of display devices such as organic electro luminescence (EL) displays, also called organic light emitting diode (OLED) displays, field emission displays (FEDs), liquid crystal displays (LCDs), plasma display panels (PDP) and the like have been developed as display devices substituting for cathode ray tube (CRT) displays.

Among those display devices, the organic EL display is a self light-emitting display device using electroluminescence. The organic EL display, when compared to a display device requiring a separate light source, such as an LCD, is superior in terms of the motion picture characteristic, the viewing angle characteristic, and the color reproduction characteristic, thus attracting much attention, especially as a next-generation display device. The electroluminescence phenomenon refers to a phenomenon in which differential energy is discharged as light when the electronic state of a material (an organic EL device) is changed from a ground state to an excited state by an electric field and the electronic state is returned from an unstable excited state to a stable ground state.

The foregoing display devices generally display an image on a display screen by matrix-type driving. For example, the display device includes several pixels arranged in a matrix form, in which a data line to which a data voltage (a data signal) according to an image signal is applied and a scan line to which a selection voltage (a selection signal; also called as a scan voltage) for selectively applying the data voltage is applied are connected to each of the pixels. The display device displays an image according to the image signal on a display screen by selectively applying the data voltage and the selection voltage to each of the pixels.

In the display device which displays the image on the display screen in a matrix form as described above, the original luminance of the image signal may be degraded in a part of the display screen. This phenomenon may occur due to a voltage drop caused by, for example, an influence of interconnection impedance (electrode impedance) in a line (an electrode) such as a scan line.

In the meantime, techniques which detect a load in each line in a horizontal direction based on an input image signal and correct the image signal based on a result of detection have been developed. Examples of the techniques may include Patent Document 1 and Patent Document 2.

[Patent Document 1] Jpn. Pat. Appln. Laid-Open Publication No. 2008-145880

[Patent Document 2] Jpn. Pat. Appln. Laid-Open Publication No. 2005-62337

SUMMARY OF THE INVENTION

A display device (which will hereinafter be referred to as a conventional display device) using a related art technique for detecting a load in each line in a horizontal direction based on an input image signal and correcting the image signal based on a result of detection (which may hereinafter be briefly referred to as a related art technique) detects the load based on the input image signal and corrects the image signal. Thus, the related art display device may prevent luminance degradation caused by a voltage drop (to some degree) even when the voltage drop occurs due to an influence of interconnection impedance in various kinds of signal lines (electrodes). Here, a cause for luminance degradation in a display device which displays an image on a display screen in a matrix manner is not limited to a voltage drop in a signal line oriented in a horizontal direction of the display screen (e.g., a scan line to which a scan voltage is applied). For example, in a display device which displays an image on a display screen in a matrix manner, a voltage drop may also occur due to an influence of electrode impedance in a signal line oriented in a vertical direction of the display screen (e.g., a data line to which a data voltage is applied) or a power supply line which supplies a drive voltage to each pixel. However, the related art display device detects only a load in a horizontal direction of a display screen (e.g., the direction of a scan line to which a scan voltage is applied) and corrects an image signal according to a result of detection. That is, the related art display device takes no action with respect to a voltage drop occurring in a signal line oriented in a vertical direction of a display screen. Therefore, even when the conventional technique is used, luminance degradation may occur, failing to achieve a high display quality in the conventional display device.

The present invention has been made to address the foregoing problem and provides an apparatus for processing an image signal, a program, and an apparatus for displaying an image signal, in which a high display quality display may be achieved by detecting a load in each of a horizontal direction and a vertical direction of a display screen based on an input image signal.

According to an aspect of the present invention, there is provided an apparatus for processing an image signal, the apparatus including a first correction value derivation unit deriving a first correction value for correcting an input image signal for each pixel of a line in a horizontal direction, for each pixel based on the input image signal, a second correction derivation unit deriving a second correction value for correcting the input image signal for each pixel of a line in a vertical direction, for each pixel based on the input image signal, a third correction value derivation unit deriving a third correction value for correcting the input image signal for each pixel forming a display screen which displays an image, for each pixel based on the first correction value and the second correction value, and a signal correction unit correcting the input image signal based on the third correction value.

The apparatus may detect a load in each of a horizontal direction and a vertical direction of a display screen based on an input image signal and correct the image signal based on a correction value (the third correction value) based on a result of the detection. Accordingly, with this structure, the load in each of the horizontal direction and the vertical direction of the display screen may be detected based on the input image signal, thereby achieving a high display quality.

The first correction value derivation unit may include a horizontal load detection unit detecting a load for each pixel of a line in the horizontal direction, based on the input image signal and a horizontal correction value derivation unit deriving the first correction value, based on a result of the detection performed by the horizontal load detection unit.

With this structure, the load in the horizontal direction may be detected and the correction value (the first correction value) according to a result of the detection may be derived.

The second correction value derivation unit may include a vertical load detection unit detecting a load for each pixel of a line in the vertical direction, based on the input image signal, and a vertical correction value derivation unit deriving the second correction value, based on a result of the detection performed by the vertical load detection unit.

With this structure, the load in the vertical direction may be detected and the correction value (the second correction value) according to a result of the detection may be derived.

The third correction value derivation unit may derive the third correction value by multiplying each pixel by the first correction value and the second correction value.

With this structure, the third correction value for correcting the image signal for each pixel may be derived from the first correction value based on the load in the horizontal direction and the second correction value based on the load in the vertical direction.

According to another aspect of the present invention, there is provided a program for executing operations on a computer, the operations including deriving a first correction value for correcting an input image signal for each pixel of a line in a horizontal direction, for each pixel based on an input image signal, deriving a second correction value for correcting the input image signal for each pixel of a line in a vertical direction, for each pixel based on the input image signal, deriving a third correction value for correcting the input image signal for each pixel forming a display screen which displays an image, for each pixel based on the first correction value and the second correction value, and correcting the input image signal based on the third correction value.

By using the program, the load in each of the horizontal direction and the vertical direction of the display screen may be detected based on the input image signal, thereby achieving a high display quality.

According to another aspect of the present invention, there is provided an apparatus for displaying an image signal, the apparatus including an image signal correction unit correcting an input image signal and an image display unit including several pixels arranged in a matrix form, the image display unit displaying an image based on an image signal corrected by the image signal correction unit, in which the image signal correction unit includes a first correction value derivation unit deriving a first correction value for correcting an input image signal for each pixel of a line in a horizontal direction, for each pixel based on the input image signal, a second correction derivation unit deriving a second correction value for correcting the input image signal for each pixel of a line in a vertical direction, for each pixel based on the input image signal, a third correction value derivation unit deriving a third correction value for correcting the input image signal for each pixel forming a display screen which displays an image, for each pixel based on the first correction value and the second correction value, and a signal correction unit correcting the input image signal based on the third correction value.

With this structure, the load in each of the horizontal direction and the vertical direction of the display screen may be detected based on the input image signal, thereby achieving a high display quality.

According to another aspect of the present invention, there is provided an apparatus for displaying an image signal, the apparatus including an image display unit including several pixels arranged in a matrix form, the image display unit changing an offset value, which specifies conversion from the input image signal into a data voltage applied to each pixel, on a basis of a correction value based on the input image signal and displaying an image based on the input image signal on a display screen, and a correction value derivation unit deriving the correction value based on the input image signal, in which the correction value derivation unit includes a first correction value derivation unit deriving a first correction value for correcting an input image signal for each pixel of a line in a horizontal direction, for each pixel based on the input image signal, a second correction derivation unit deriving a second correction value for correcting the input image signal for each pixel of a line in a vertical direction, for each pixel based on the input image signal, and a third correction value derivation unit deriving the correction value for setting an offset value corresponding to each pixel of the display screen, for each pixel based on the first correction value and the second correction value.

With this structure, the load in each of the horizontal direction and the vertical direction of the display screen may be detected based on the input image signal, thereby achieving a high display quality.

BRIEF DESCRIPTION OF THE DRAWINGS

The above and other aspects of the present invention will become more apparent by describing in detail exemplary embodiments thereof with reference to the attached drawings, in which.

DETAILED DESCRIPTION OF EXEMPLARY EMBODIMENTS

Figure 1:
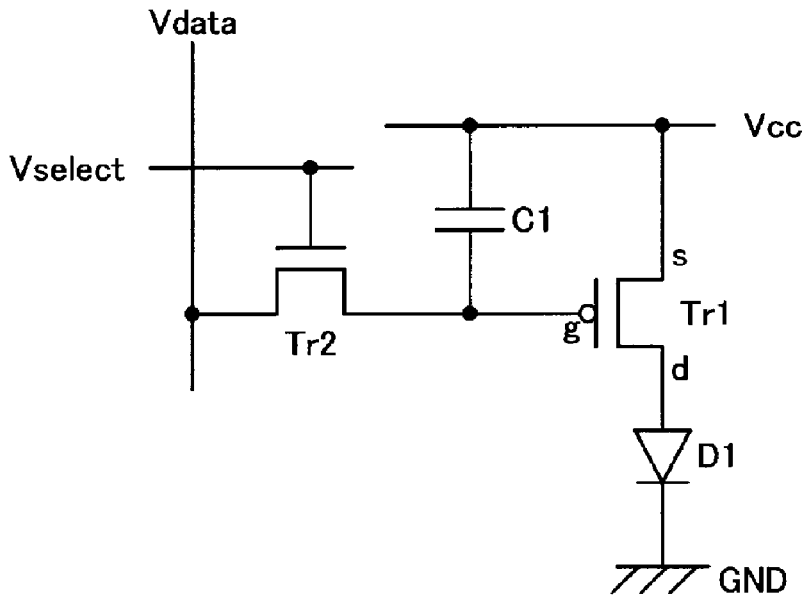
FIG. 1 is an explanatory diagram showing an example of a pixel circuit included in an apparatus for displaying an image signal according to an exemplary embodiment.

Hereinafter, exemplary embodiments will be described in detail with reference to the accompanying drawings. In this specification and the drawings, structural elements that have substantially the same functional structure are assigned the same reference numerals, such that duplicative descriptions will not be given.

In the following description, an organic electro luminescence (EL) display which is a self light-emitting display device which emits light according to a current flowing through a light emitting device will be used as an example of an apparatus for displaying an image signal according to an exemplary embodiment. However, the apparatus for displaying an image signal according to an exemplary embodiment is not limited to an organic EL display and can be applied to various display devices, such as a liquid crystal display (LCD), in which pixels are arranged in a matrix form.

Approach to Achieve High Display Quality

An approach to achieve a high display quality in an apparatus for displaying an image signal according to an exemplary embodiment will be described prior to a description of a structure of the apparatus for displaying an image signal according to an exemplary embodiment. Hereinafter, the apparatus for displaying an image signal according to an exemplary embodiment will be collectively referred to as a display apparatus which will be used as an example for description. The approach to achieve a high display quality to be described below can be applied to a display apparatus 100 according to a first exemplary embodiment and a display apparatus 200 according to a second exemplary embodiment.

(1) Problem which May Occur in Display Apparatus

A description will be made of a problem which may occur in the display apparatus prior to a detailed description of the approach to achieve a high display quality in the display apparatus.

When the display apparatus includes an organic EL device as a light emitting device, each of pixels forming a display panel which displays an image on a display screen may include, for example, a light emitting device and a transistor (which hereinafter will be referred to as a drive transistor) which is connected to the light emitting device to control the supply of a light emitting current to the light emitting device. FIG. 1 is an explanatory diagram showing an example of a pixel circuit included in the display apparatus according to an exemplary embodiment. Although the pixel circuit includes two thin film transistor (which hereinafter will be referred to as transistors), a capacitor C1, and a light emitting device D1 in FIG. 1, the pixel circuit according to an exemplary embodiment is not limited to such a structure.

Referring to FIG. 1, the pixel circuit according to an exemplary embodiment includes a p-channel transistor Tr1, an n-channel transistor Tr2, the capacitor C1, and the light emitting device D1. Herein, the p-channel transistor Tr1 controls supply of a light emitting current to the light emitting device D1. The n-channel transistor Tr2 serves as a switch which selectively applies a data voltage Vdata according to an image signal to a gate terminal (a control terminal) of the p-channel transistor Tr1. Hereinafter, the p-channel transistor Tr1 and the n-channel transistor Tr2 will be referred to as a drive transistor Tr1 and a switching transistor Tr2, respectively.

A drain terminal (a first terminal) of the drive transistor Tr1 is connected to an anode of the light emitting device D1, and a source terminal (a second terminal) of the drive transistor Tr1 is connected to a power supply line to which a drive voltage Vcc is applied. A cathode of the light emitting device D1 is connected to a common electrode. Although a voltage level of the common electrode is a ground level GND in FIG. 1 by way of example, it may be set to an arbitrary voltage level capable of driving each pixel, without being limited to the ground level GND. The display apparatus may include the common electrode which may be, for example, a transparent electrode made of indium-tin-oxide (ITO) or other metals.

A terminal of the capacitor C1 is connected to the power supply line, and another terminal of the capacitor C1 is connected to a gate terminal (a control terminal) of the drive transistor Tr1. A first terminal of the switching transistor Tr2 is connected to a data line to which the data voltage Vdata is applied, and a second terminal of the switching transistor Tr2 is connected to the gate terminal of the drive transistor Tr1. A gate terminal (a control terminal) of the switching transistor Tr2 is connected to a scan line to which a scan voltage Vselect is applied. Thus, the switching transistor Tr2 applies the data voltage Vdata to the gate terminal of the drive transistor Tr1 according to the scan voltage Vselect applied to the gate terminal of the switching transistor Tr2.

As the data voltage Vdata is applied to the gate terminal of the drive transistor Tr1, a light emitting current according to the data voltage Vdata flows between a drain and a source of the drive transistor Tr1 and then is applied to the light emitting device D1. Thus, in the pixel circuit, the light emitting device D1 emits light by a light emission amount which is based on the light emitting current. Herein, a structure illustrated in FIG. 1 is referred to as a constant-current drive structure.

Although the constant-current drive structure is shown as the pixel circuit according to an exemplary embodiment in FIG. 1, the pixel circuit according to an exemplary embodiment is not limited to the constant-current drive structure. For example, the pixel circuit according to an exemplary embodiment may be a structure called a source follower (or a drain ground). The pixel circuit according to an exemplary embodiment may also be structured with a drive transistor using an n-channel transistor or a switching transistor using a p-channel transistor.

As shown in FIG. 1, a scan line (a scan electrode) to which the scan voltage Vselect is applied, a data line (a data electrode) to which the data voltage Vdata is applied, and a power supply line (a power supply electrode) to which the drive voltage Vcc is applied are connected to each of pixels included in the display apparatus. Herein, in the display apparatus, a scan driver selectively applies the scan voltage Vselect to the scan line, and a data driver selectively applies the data voltage Vdata to the data line. More specifically, in the display apparatus, the data driver applies the data voltage Vdata according to the image signal to a pixel connected to the scan line selected by the scan driver. In the display apparatus, once application of the data voltage Vdata to each pixel (application to the gate terminal of the drive transistor Tr1) is completed in the scan line, selection with respect to the scan line is terminated and the scan driver selects another scan line. By repeating such a process, the display apparatus displays the image represented by the image signal on the display screen. A description will now be made of a voltage drop that may occur in each signal line (electrode) included in the display apparatus and a problem caused by the voltage drop.

[A] Scan Line (Scan Electrode)

Figure 2:
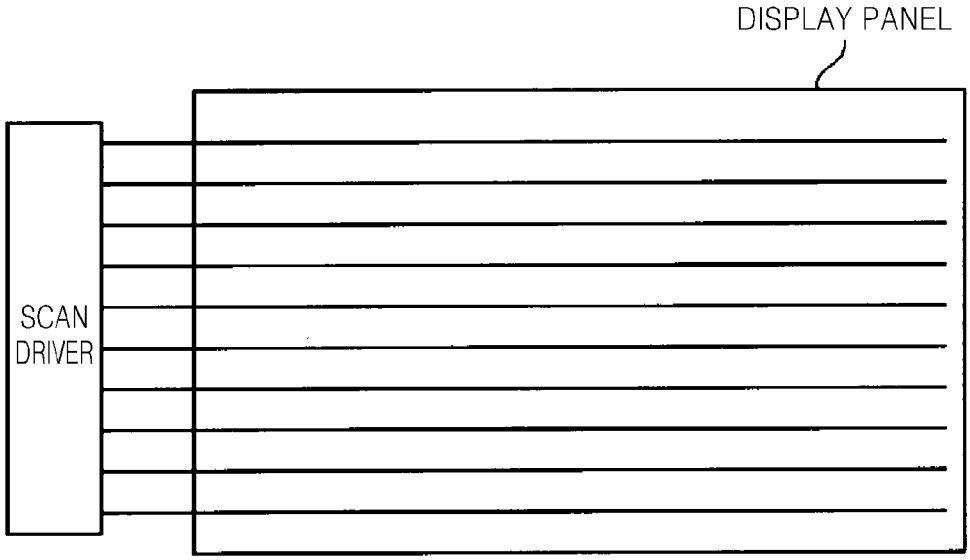
FIG. 2 is an explanatory diagram showing an example of a structure of a scan line in an apparatus for displaying an image signal according to an exemplary embodiment.

FIG. 2 is an explanatory diagram showing an example of a structure of scan lines in the display apparatus according to an exemplary embodiment. As shown in FIG. 2, the display apparatus includes a plurality of scan lines, e.g., formed in a horizontal direction of a display panel, and the scan lines are connected to a scan driver. That is, in the example shown in FIG. 2, a scan voltage Vselect is delivered from a left portion to a right portion of the display panel. Thus, in the example shown in FIG. 2, the impedance of each scan line increases in the horizontal direction from the left portion to the right portion of the display panel. In other words, in the example shown in FIG. 2, a drop in the scan voltage Vselect applied to each scan line is greater at the right portion compared to the left portion of the display panel. In each pixel of the display apparatus, the scan voltage Vselect delivered in a scan line is used for on/off operations of the switching transistor Tr2 as shown in FIG. 1. Thus, even when a drop in the scan voltage Vselect occurs, an influence of the drop in the scan voltage Vselect is insignificant if a level of the drop in the scan voltage Vselect does not obstruct the on/off operations of the switching transistor Tr2. However, if the drop in the scan voltage Vselect reaches a level which obstructs the on/off operations of the switching transistor Tr2, the data voltage Vdata cannot be applied to the gate terminal of the drive transistor Tr1 even if the scan voltage Vselect is applied to a pixel. In this case, the pixel cannot cause a light emitting device to emit light.

[B] Data Line (Data Electrode)

Figure 3:
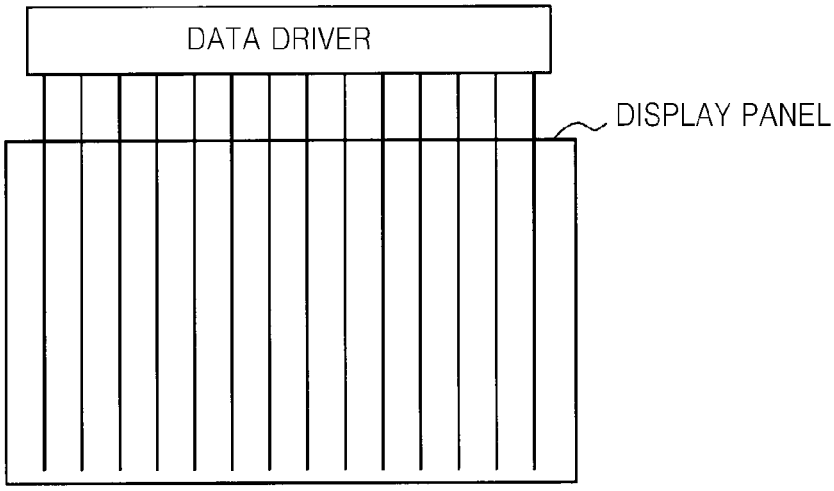
FIG. 3 is an explanatory diagram showing an example of a structure of a data line in an apparatus for displaying an image signal according to an exemplary embodiment.

FIG. 3 is an explanatory diagram showing an example of a structure of a data line in the display apparatus according to an exemplary embodiment. As shown in FIG. 3, the display apparatus includes a plurality of data lines, e.g., in a vertical direction of the display panel, and the data lines are connected to a data driver. That is, in the example shown in FIG. 3, the data voltage Vdata is delivered from an upper portion to a lower portion of the display panel. Thus, in the example shown in FIG. 3, the impedance of each data line increases in the vertical direction from the upper portion to the lower portion of the display panel. In other words, in the example shown in FIG. 3, a drop in the data voltage Vdata applied to each data is greater at the lower portion compared to the upper portion of the display panel. Herein, if each pixel is structured with the pixel circuit shown in FIG. 1 in the display apparatus, the drive transistor Tr1 may use a p-channel transistor. Thus, if each pixel is structured with the pixel circuit shown in FIG. 1 in the display apparatus, a light emitting current, which is larger at pixels positioned in the lower portion of the display panel than a light emitting current that should be applied to a light emitting device, is applied to the light emitting device due to the drop in the data voltage Vdata. In this case, a luminance of a pixel increases in a direction toward the lower portion of the display panel, resulting in deterioration of a display quality, and a large current flows through the light emitting device, hastening the degradation of the light emitting device. If the drive transistor Tr1 of each pixel is structured with an n-channel transistor in the display apparatus, luminance is lowered, for example, at pixels positioned in the lower portion of the display panel.

[C] Power Supply Line (Power Supply Electrode)

Figure 4:
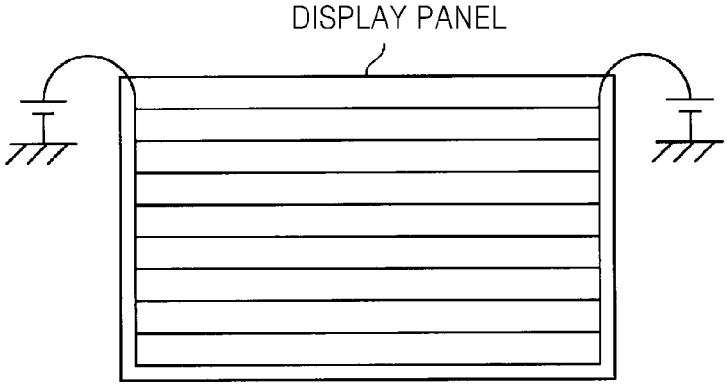
FIG. 4 is an explanatory diagram showing an example of a structure of a power supply line in an apparatus for displaying an image signal according to an exemplary embodiment.

FIG. 4 is an explanatory diagram showing an example of a structure of a power supply line in the display apparatus according to an exemplary embodiment. As shown in FIG. 4, the display apparatus may include power supply lines in a horizontal direction of a display panel, to both sides of which a common power source (a drive power supply unit) is connected. In FIG. 4, since the common power source is connected to both sides of the display panel, impedance in a central portion of the display panel is largest. That is, in FIG. 4, a drop in the drive voltage Vcc applied to the power supply line increases in the horizontal direction from the left and right portion to the central portion of the display panel. Herein, if each pixel is structured with the pixel circuit shown in FIG. 1 in the display apparatus, a voltage between the gate and the source of the drive transistor Tr1 drops in case of a drop in the drive voltage Vcc, whereby the amount of a light emitting current flowing through the light emitting device is reduced. Thus, in the display apparatus, luminance degradation occurs in the central portion of the display panel due to a voltage drop in the power supply line.

As described in [A] to [C], in the display apparatus, quality degradation may occur in various ways due to voltage drops in signal lines (electrodes). Herein, the amount of reduction in impedance in each signal line (each electrode) changes according to an input image signal (i.e., an image represented by an image signal). Thus, the amount of reduction in impedance in each signal line (each electrode) cannot be uniquely set merely based on a position of a pixel.

A description will now be made of detailed examples of an image having quality degradation. In the following description, it is assumed that the display apparatus has the structures shown in FIGS. 2 to 4. If the display apparatus includes a data driver disposed below a display panel, a phenomenon described in [B] would occur in the upper portion of the display panel. If the display apparatus includes a scan driver disposed at the right side of the display panel, a phenomenon described in [A] may occur in the left portion of the display panel. In addition, a portion of the display panel in which a phenomenon described in [C] may occur may change according to the number or position of power sources which apply the drive voltage Vcc to the power supply lines.

[D] Detailed Examples in which Quality Degradation Occurs

Figure 5:
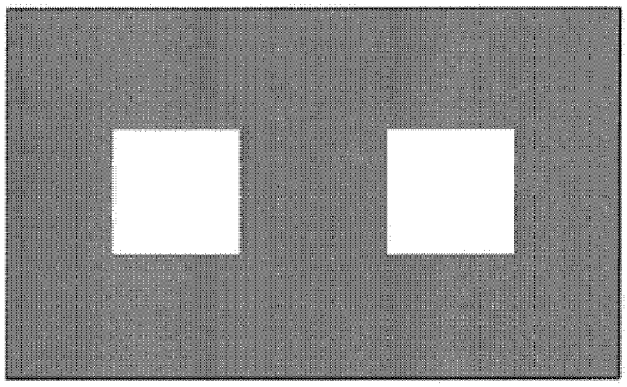
FIG. 5 is a first explanatory diagram for explaining quality degradation according to an exemplary embodiment.
Figure 6:
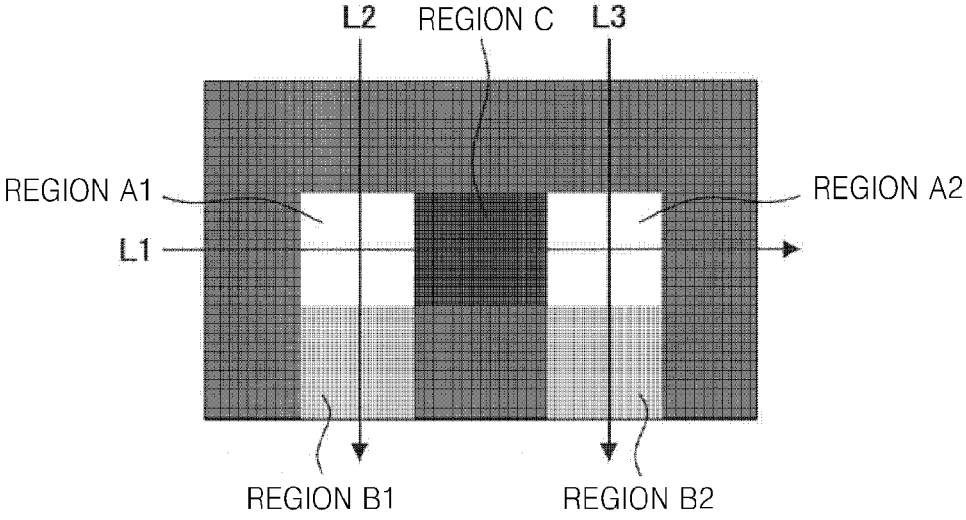
FIG. 6 is a second explanatory diagram for explaining quality degradation according to an exemplary embodiment.

FIG. 5 is a first explanatory diagram for explaining quality degradation according to an exemplary embodiment, and FIG. 6 is a second explanatory diagram for explaining quality degradation according to an exemplary embodiment. Herein, FIG. 5 shows an example of an image in which quality degradation may occur, and FIG. 6 shows an example in which an image signal representing the image shown in FIG. 5 is displayed on a display screen. The example shown in FIG. 6 is a display example to which an approach to achieve a high display quality according to an exemplary embodiment, which will be described below, is not applied. In the example shown in FIG. 6, the phenomena described in [B] and [C] occurs.

As mentioned previously, in the data line shown in FIG. 3, a drop in the data voltage Vdata is greater at the lower portion of the display panel. In the power supply line shown in FIG. 4, a drop in the drive voltage Vcc is greater at the central portion of the display panel. As a result, when the image signal representing the image shown in FIG. 5 is displayed on the display screen, luminance of regions B1 and B2 below regions A1 and A2 having high luminance (regions having the largest luminance in FIG. 6) may increase, whereas the luminance of a region C in the central portion of the display screen may decrease. More specifically, referring to a line L1 in a horizontal direction in FIG. 6, a drop in the drive voltage Vcc increases due to the regions A1 and A2, lowering the luminance of the region C. Referring to lines L2 and L3 in a vertical direction in FIG. 6, a drop in the data voltage Vdata increases due to the regions A1 and A2, increasing a light emitting current and thus increasing the luminance of the regions B1 and B2.

Herein, the drop in the data voltage Vdata is greater at the lower portion compared to the upper portion of the display panel, but luminance of the other regions than the regions B1 and B2 in the lower portion of the display panel do not increase as shown in FIG. 6. This is because the amount of reduction in impedance in each signal line (each electrode) changes according to an input image signal. Although not shown in FIG. 6, more strictly, luminance may change due to a voltage drop occurring in each of a data line, a power supply line, and the like.

As shown in FIG. 6, if a voltage drop of each signal occurs in every signal line (every electrode), a high display quality cannot be expected. The display apparatus according to an exemplary embodiment achieves a high display quality, for example, by preventing the occurrence of a phenomenon shown in FIG. 6. Thus, the approach to achieve a high display quality according to an exemplary embodiment will hereinafter be described.

(2) Approach to Achieve High Display Quality

Figure 7:
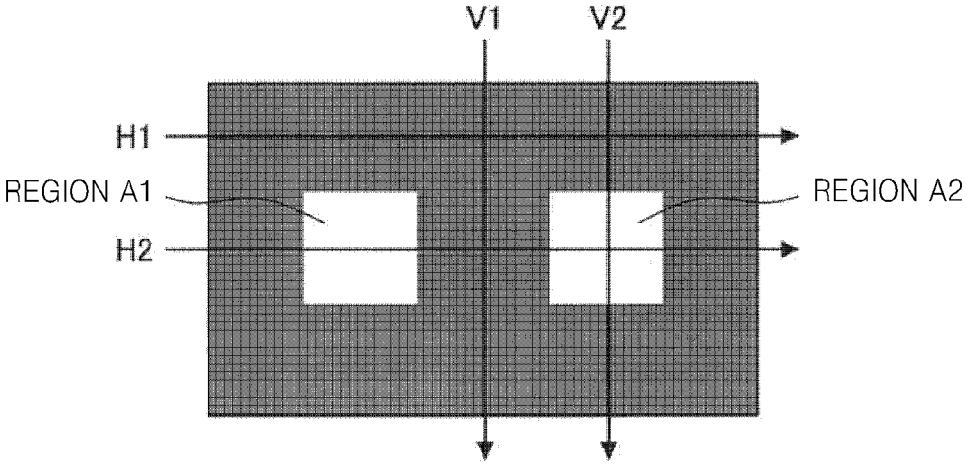
FIG. 7 is a first explanatory diagram for explaining an approach to achieve a high display quality according to an exemplary embodiment.

The display apparatus 1000 may achieve a high display quality, for example, through processes [I] to [IV] described below. FIG. 7 is a first explanatory diagram for explaining the approach to achieve a high display quality according to an exemplary embodiment. Herein, FIG. 7 shows the same image as that shown in FIG. 5.

[I] Derivation of First Correction Value Based on Load in Horizontal Direction

The display apparatus derives a first correction value for correcting an image signal for each pixel of a line in a horizontal direction based on an input image signal. Herein, the horizontal direction according to an exemplary embodiment may be, for example, a row direction of pixels arranged in a matrix form included in the display apparatus. In other words, if the display apparatus includes the pixel circuit shown in FIG. 1 in each pixel, the horizontal direction is a direction in which scan lines and power supply lines can be provided. If the display apparatus includes the pixel circuit shown in FIG. 1 in each pixel, the vertical direction may also be a direction in which data lines can be provided. Thus, a line in the horizontal direction according to an exemplary embodiment is a row of a pixel group of pixels arranged in the horizontal direction (or a signal line (an electrode) in the horizontal direction, connected to a pixel included in the pixel group). For example, in FIG. 7, each of lines H1 and H2 is a line in the horizontal direction.

Correction values according to an exemplary embodiment (the first, second and third correction values to be described below) may be used, for example, but not limited to, for correction of an image signal based on signal processing (in a first exemplary embodiment to be described below). For another example, a correction value according to an exemplary embodiment may be used to change an offset value which specifies conversion from the image signal into the data voltage Vdata applied to a pixel (in a second exemplary embodiment to be described below).

Figure 8A:
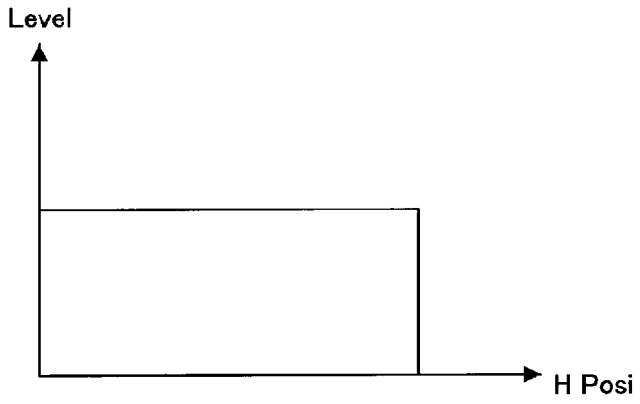
FIGS. 8A to 8C are second explanatory graphs for explaining the approach to achieve a high display quality according to an exemplary embodiment.
Figure 8B:
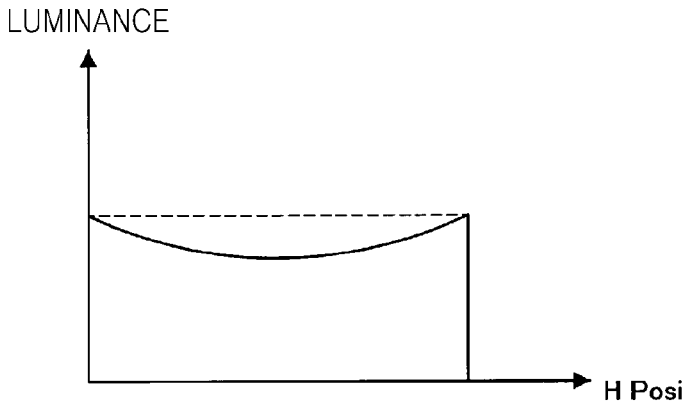
Figure 8C:
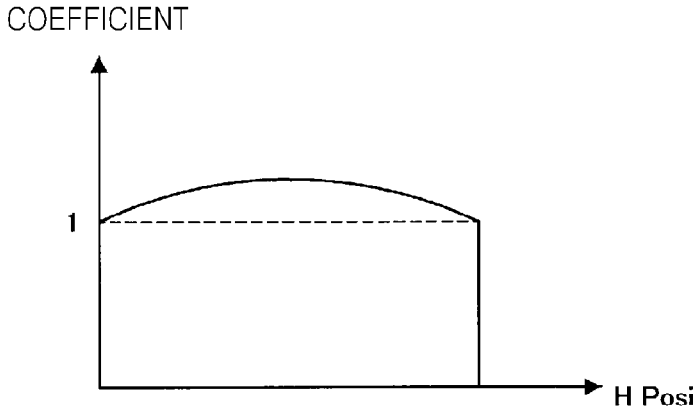

More specifically, the display apparatus derives the first correction value through processes [I-1] and [I-2] to be described below. Hereinafter, a detailed description will be made with references to FIGS. 8A to 9C. FIGS. 8A to 8C are second explanatory diagrams for explaining the approach to achieve a high display quality according to an exemplary embodiment. Herein, FIG. 8A is a graph showing a load in the line H1 shown in FIG. 7, FIG. 8B is a graph showing luminance degradation that may occur in the line H1, and FIG. 8C is a graph showing an example of a first correction value for the line H1 shown in FIG. 7. FIGS. 8B and 8C have some exaggeration for convenience of explanation. Thus, the first correction value derived by the display apparatus for the line H1 shown in FIG. 7 is not limited to the example shown in FIG. 8C.

Figure 9A:
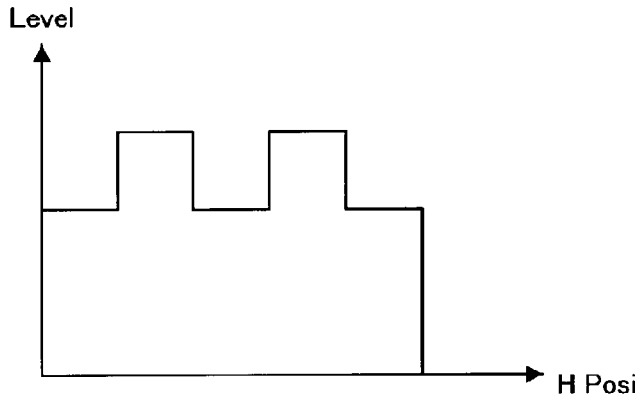
FIGS. 9A to 9C are third explanatory graphs for explaining the approach to achieve a high display quality according to an exemplary embodiment.
Figure 9B:
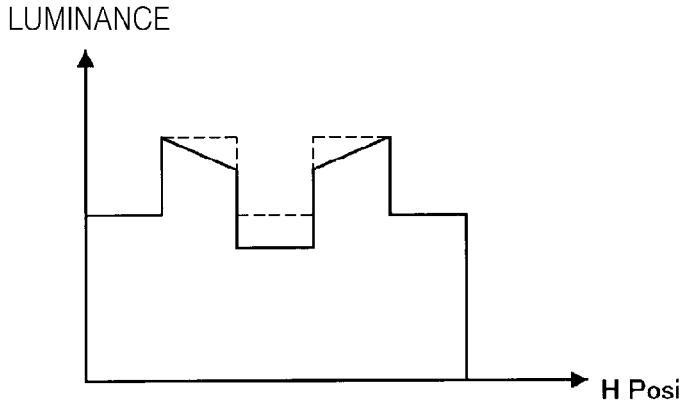
Figure 9C:
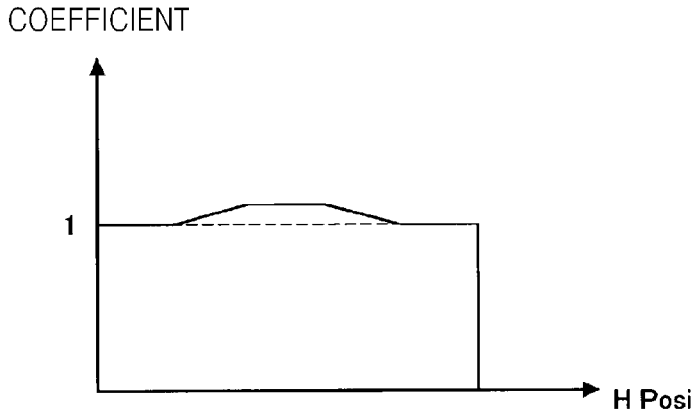

FIGS. 9A to 9C are third explanatory diagrams for explaining the approach to achieve a high display quality according to an exemplary embodiment. Herein, FIG. 9A is a graph showing a load in the line H2 shown in FIG. 7, FIG. 9B is a graph showing luminance degradation that may occur in the line H2, and FIG. 9C is a graph showing an example of a first correction value for the line H2 shown in FIG. 7. FIGS. 9B and 9C have some exaggeration for convenience of explanation. Thus, the first correction value derived by the display apparatus for the line H2 shown in FIG. 7 is not limited to the example shown in FIG. 9C.

[I-1] Detection of Load in Horizontal Direction

The display apparatus detects a load in a horizontal direction for each pixel of a line in the horizontal direction based on an input image signal. For example, luminance is constant in the line H1 shown in FIG. 7, and thus a load distribution has a uniform signal level as shown in FIG. 8A. The regions A1 and A2 having high luminance exist in the line H2 shown in FIG. 7, and thus a load distribution has peak signal levels corresponding to the regions A1 and A2 as shown in FIG. 9A.

[I-2] Derivation of First Correction Value

The display apparatus derives the first correction value for each pixel based on the load detected in the process [I-1].

For example, in the lines H1 and H2 shown in FIG. 7, luminance is lower at the central portion than the other portions of the display panel as shown in FIGS. 8B and 9B. Thus, the display apparatus derives the first correction value for denying an influence of luminance degradation. Herein, FIGS. 8C and 9C show examples in which the display apparatus derives a correction coefficient for correcting the image signal during signal processing as the first correction value.

More specifically, the display apparatus memorizes, for example, a lookup table in which a signal level of an image signal and a first correction value are mapped to each other for each position (a position corresponding to a pixel) in the horizontal direction. The display apparatus derives the first correction value according to the input image signal (i.e., according to a result of the detection in [I-1]) for each pixel by using the lookup table.

Herein, information memorized in the lookup table may be previously set through measurement of luminance degradation by using an image signal representing an image which is much affected by a voltage drop in each signal line (each electrode) like the image shown in FIG. 5 (i.e., an image having prominent luminance degradation), but the present invention is not limited thereto. For example, the information memorized in the lookup table may be set after a condition such as the size of the display panel is properly set. The information set as described above is memorized in the lookup table, whereby the display apparatus can uniquely derive the first correction value corresponding to various conditions such as the size of the display panel included in the display apparatus.

The display apparatus may derive the first correction value derived based on a load in the horizontal direction, for each pixel through the processes [I-1] and [I-2].

[II] Derivation of Second Correction Value Based on Load in Vertical Direction

The display apparatus derives a second correction value for correcting an image signal for each pixel of a line in a vertical direction, for each pixel based on an input image signal. Herein, the vertical direction according to an exemplary embodiment may be, for example, a column direction of the pixels arranged in a matrix form included in the display apparatus. In other words, if the display apparatus includes the pixel circuit shown in FIG. 1 in each pixel, the vertical direction is a direction in which data lines are provided. If the display apparatus includes the pixel circuit shown in FIG. 1 in each pixel, the horizontal direction may be a direction in which scan lines and power supply lines are provided. Thus, a line in the vertical direction according to an exemplary embodiment is a column of a pixel group of pixels arranged in the vertical direction (or a signal line (an electrode) in the vertical direction, connected to a pixel included in the pixel group). For example, in FIG. 7, each of lines V1 and V2 is a line in the vertical direction.

More specifically, the display apparatus derives the second correction value through processes [II-1] and [II-2] to be described below. Hereinafter, a detailed description will be made with proper reference to FIGS. 10A to 11C.

Figure 10A:
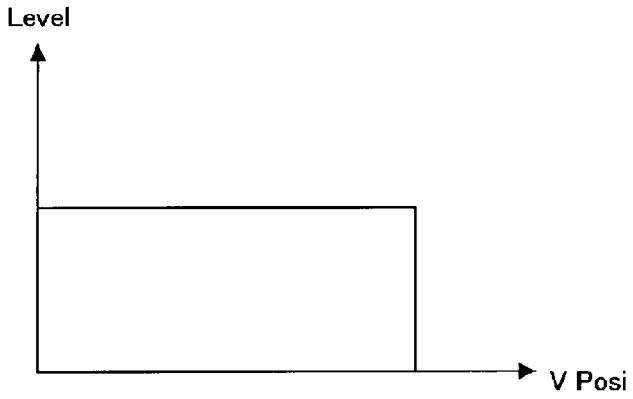
FIGS. 10A to 10C are fourth explanatory graphs for explaining the approach to achieve a high display quality according to an exemplary embodiment.
Figure 10B:
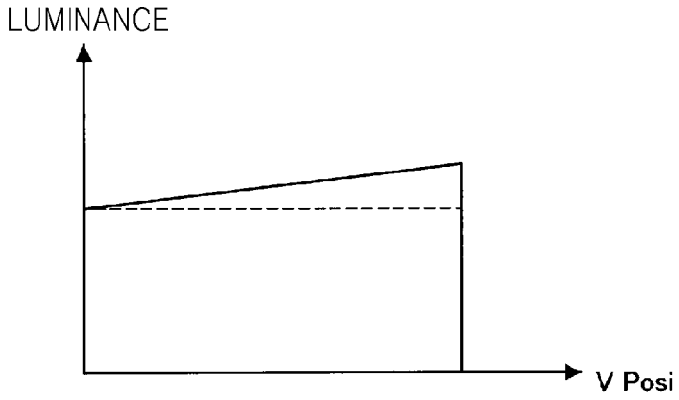
Figure 10C:
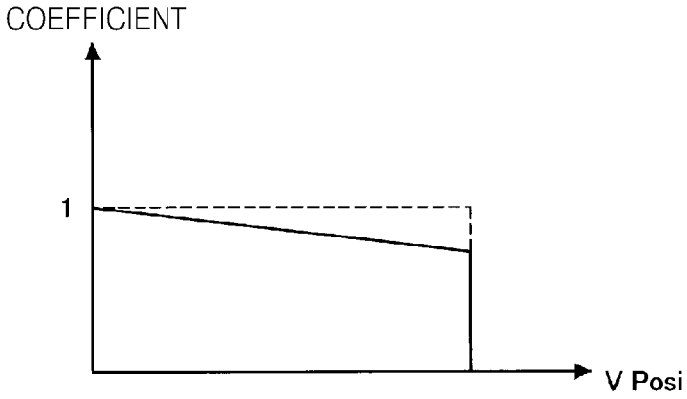

FIGS. 10A to 10C are fourth explanatory diagrams for explaining the approach to achieve high display quality according to an exemplary embodiment. Herein, FIG. 10A shows a load in the line V1 shown in FIG. 7, FIG. 10B shows an example of a luminance change that may occur in the line V1, and FIG. 10C shows an example of the second correction value for the line V1. FIGS. 10B and 10C have some exaggeration for convenience of explanation. Thus, the second correction value derived by the display apparatus for the line V1 is not limited to the example shown in FIG. 10C.

Figure 11A:
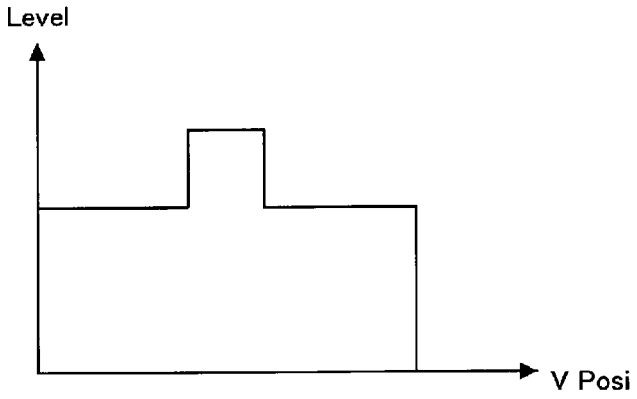
FIGS. 11A to 11C are fifth explanatory graphs for explaining the approach to achieve a high display quality according to an exemplary embodiment.
Figure 11B:
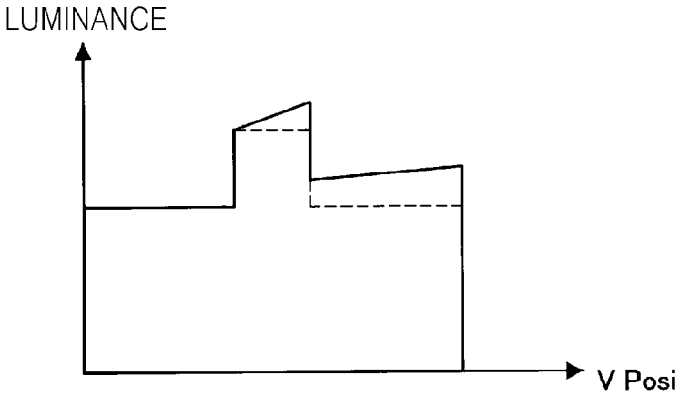
Figure 11C:
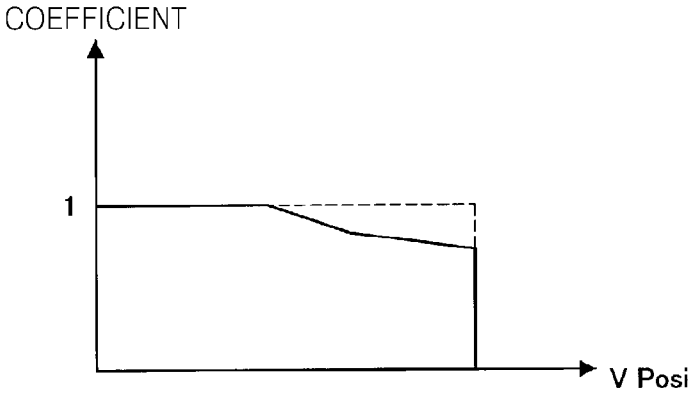

FIGS. 11A to 11C are fifth explanatory diagrams for explaining the approach to achieve a high display quality according to an exemplary embodiment. Herein, FIG. 11A shows a load in the line V2 shown in FIG. 7, FIG. 11B shows an example of luminance degradation that may occur in the line V2, and FIG. 11C shows an example of the second correction value for the line V2. FIGS. 11B and 11C have some exaggeration for convenience of explanation. Thus, the second correction value derived by the display apparatus for the line V2 is not limited to the example shown in FIG. 11C.

[II-1] Detection of Load in Vertical Direction

The display apparatus detects a load in a vertical direction for each pixel of a line in the vertical direction based on an input image signal. For example, luminance is constant in the line V1 shown in FIG. 7, and thus a load distribution has a uniform signal level as shown in FIG. 10A. The regions A2 having high luminance exists in the line V2 shown in FIG. 7, and thus a load distribution has a peak signal level corresponding to the region A2 as shown in FIG. 11A.

[II-2] Derivation of Second Correction Value

The display apparatus derives the second correction value based on the load detected in the process [II-1].

For example, in the lines V1 and V2 shown in FIG. 7, luminance is greater at the lower portion of the display panel as shown in FIGS. 10B and 11B. Thus, the display apparatus 1000 derives the second correction value for denying an influence of luminance degradation. Herein, FIGS. 10C and 11C show examples in which the display apparatus derives the second correction value for denying an influence of the increase in luminance. Herein, FIGS. 10C and 11C show examples in which the display apparatus derives a correction coefficient for correcting the image signal during signal processing as the second correction value.

More specifically, the display apparatus memorizes, for example, a lookup table in which a signal level of an image signal and a second correction value are mapped to each other for each position (position corresponding to a pixel) in the vertical direction. The display apparatus derives the second correction value according to the input image signal (i.e., according to a result of the detection of [II-1]) for each pixel by using the lookup table. Herein, information stored in the lookup table may be set in the same manner as in the process [I], but the present invention is not limited thereto.

The display apparatus may derive the second correction value derived based on a load in the vertical direction, for each pixel through the processes [II-1] and [II-2].

[III] Derivation of Third Correction Value Based on First Correction Value and Second Correction Value As shown in FIGS. 8A through 11C, possible phenomena differ with different luminance change factors in the horizontal direction and in the vertical direction. Thus, once the first correction value and the second correction value are derived for each pixel through the processes [I] and [II], respectively, the display apparatus derives a third correction value for correcting an image signal for each pixel forming a display screen. Herein, the display apparatus derives the third correction value for each pixel, for example, by using Equation 1 as follows: Third Correction Value=(First Correction Value)×(Second Correction Value). By applying the third correction value obtained from the above Equation 1, the display apparatus can suppress an influence of a luminance change in each of the horizontal direction and the vertical direction. A method of deriving the third correction value, used by the display apparatus according to an exemplary embodiment, is not limited to the foregoing description. For example, the display apparatus may use an average value of the first correction value and the second correction value as the third correction value.

[IV] Correction of Image Signal

The display apparatus corrects the image signal based on the third correction value derived for each pixel through the process [III]. More specifically, the display apparatus corrects the image signal, for example, but not limited to, through a process [IV-1] or [IV-2] to be describe below.

[IV-1] First Correction Method: Correction Using Signal Processing

The display apparatus corrects an input image signal through signal processing based on the third correction value derived through the process [III] for each pixel. More specifically, the display apparatus corrects a gain of the image signal for each pixel by multiplying the input image signal by the third correction value. Herein, the first correction method is applied to the display apparatus 100 according to a first exemplary embodiment, which is to be described later.

[IV-2] Second Correction Method: Setting of Offset Value for Conversion from Image Signal into Data Voltage In [IV-1], the display apparatus corrects an image signal through signal processing. However, a method of correcting the image signal according to an exemplary embodiment is not limited to signal processing. For example, the display apparatus may correct the image signal by setting an offset value which specifies conversion from the image signal into a data voltage. As shown in FIG. 1, in each pixel included in the display apparatus, the data voltage Vdata according to the image signal is applied to the gate terminal of the drive transistor Tr1, whereby an image represented by the image signal is displayed on the display screen. Thus, the display apparatus may correct the image signal by applying the data voltage Vdata converted from the image signal according to the third correction value to each pixel. More specifically, the display apparatus may apply the data voltage Vdata according to the third correction value which is an offset value assigned to a digital-to-analog (D/A) converter included in a drive scanner, to each pixel (this corresponds to correction of the image signal). Herein, the second correction method is applied to the display apparatus 200 according to a second exemplary embodiment, which is to be described later.

The display apparatus corrects the image signal through the process [IV-1] or [IV-2]. Herein, the display apparatus corrects the image signal for each pixel based on the third correction value which is derived from the first correction value derived based on the load in the horizontal direction and the second correction value derived based on the load in the vertical direction. Thus, the display apparatus can suppress an influence of the luminance change in each of the horizontal direction and the vertical direction, shown in FIG. 6, thereby achieving a high display quality.

The display apparatus according to an exemplary embodiment derives a load in each of the horizontal direction and the vertical direction of the display screen based on the input image signal by performing the process [I] (derivation of the first correction value based on the load in the horizontal direction) to the process [IV] (correction of the image signal), thereby achieving a high display quality.

[Display Apparatus]

Hereinafter, the structure of the display apparatus capable of implementing the above-described approach to achieve a high display quality will be described. An image signal is input to the display apparatus in the following description, and the image signal input to the display apparatus may be a still image or a moving image. The image signal input to the display apparatus may be, but not limited, to a signal that a broadcasting station transmits and then the display apparatus receives. For example, the image signal input to the display apparatus may be transmitted from an external device over a network such as a local area network (LAN) and then received by the display apparatus, or may be an image file or a picture file which is stored in a memory unit (not shown) included in the display apparatus and then read out by the display apparatus. Although the image signal input to the display apparatus is a digital signal used for digital broadcasting in the following description, it may be an analog signal used for analog broadcasting, without being limited to the digital signal.

[Display Apparatus 100]

Figure 12:
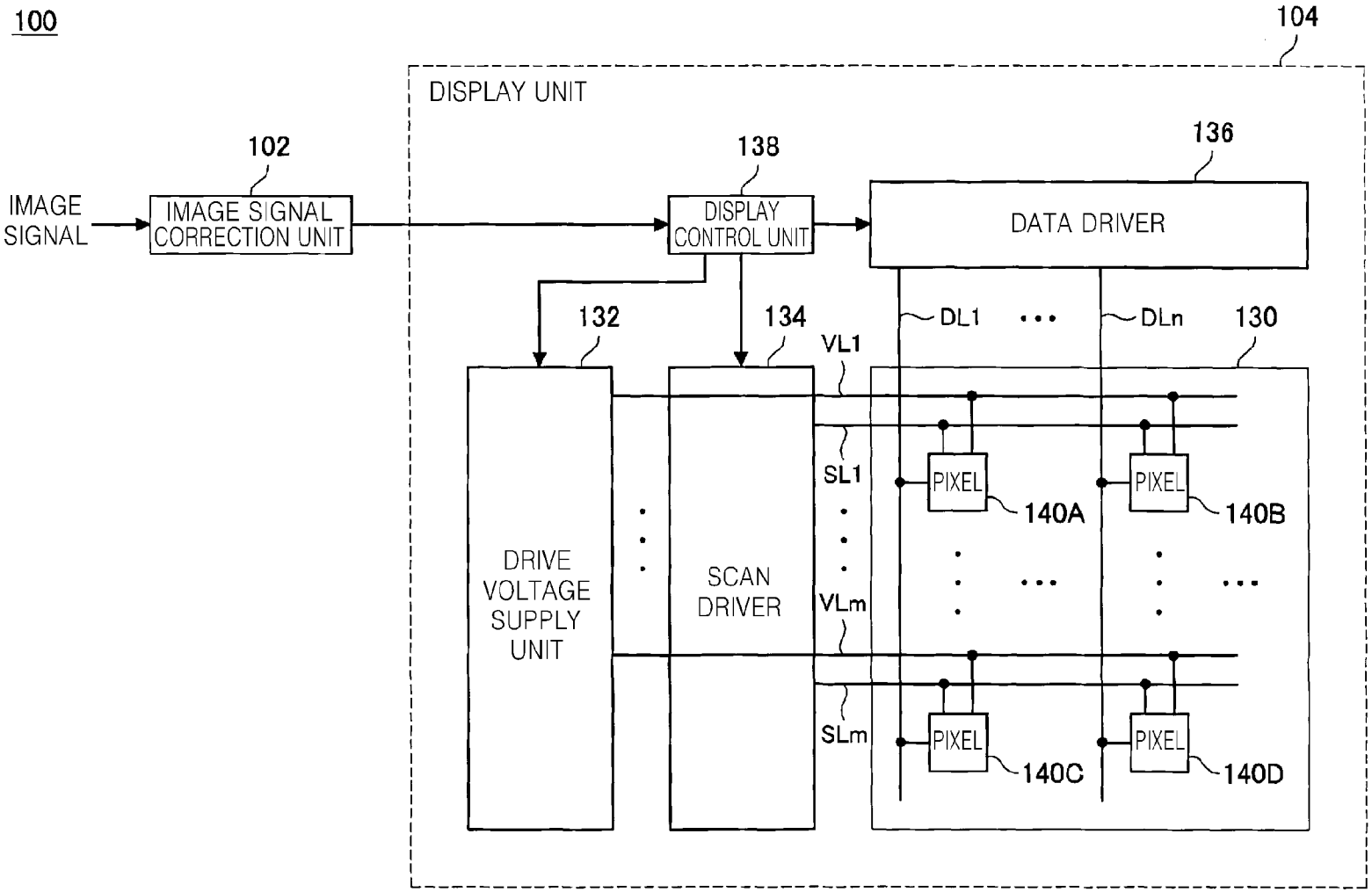
FIG. 12 is an explanatory diagram showing an apparatus for displaying an image signal according to a first exemplary embodiment.

FIG. 12 is an explanatory diagram showing a display apparatus 100 according to a first exemplary embodiment. In FIG. 12, a structure for correcting an image signal by using the first correction method described in [IV-1] which is one of the examples of the approach to achieve a high display quality is shown.

Referring to FIG. 12, the display apparatus 100 includes an image signal correction unit 102 and a display unit 104. An exemplary embodiment is not limited to this structure and, for example, the image signal correction unit 102 may be implemented with an independent device (apparatus for processing an image signal). In this case, an exemplary embodiment constitutes an image display system including the apparatus for processing an image signal and the display apparatus for displaying an image represented by a corrected image signal.

The display apparatus 100 may include a control unit (not shown) which includes a micro processing unit (MPU) to control the display apparatus 100, a read only memory (ROM: not shown) in which control data such as a program or an operation parameter used by the control unit is recorded, a random access memory (RAM: not shown) which primarily memorizes a program executed by the control unit, a reception unit (not shown) which receives an image signal transmitted from a broadcasting station, a memory unit (not shown) which memorizes an image file or a picture file, a manipulation unit (not shown) which can be manipulated by a user, and a communication unit (not shown) for communicating with an external device (not shown). The display apparatus 100 may interconnect its components through a bus which is a data transmission path.

Herein, the memory (not shown) may be, but not limited to, a magnetic storage medium such as a hard disk, and a non-volatile memory such as electrically erasable and programmable read only memory (EEPROM), a flash memory, a magnetoresistive random access memory (MRAM), a ferroelectric random access memory (FeRAM), or a phase change random access memory (PRAM). The manipulation unit (not shown) may be, but not limited to, a manipulation input device such as a keyboard or a mouse, a button, a direction key, or a combination thereof.

The display apparatus 100 and the external device (not shown) may be physically connected to each other through a universal serial bus (USB) terminal, Institute of Electrical and Electronics Engineers (IEEE) 1394 terminal, a digital visual interface (DVI) terminal, or a high-definition multimedia interface (HDMI) terminal, or may be wirelessly connected to each other through a wireless universal serial bus (WUSB) or IEEE 802.11. The display apparatus 100 and the external device (not shown) may also connected to each other through a network which may be, but not limited to, a wired network such as a LAN and a wide area network (WAN), a wireless network such a wireless local area network (WLAN) using multiple-input multiple-output (MIMO), or the Internet using a communication protocol such as transmission control protocol (TCP)/Internet protocol (IP). Thus, the communication unit (not shown) has an interface according to a type of connection with the external device (not shown).

The image signal correction unit (102) corrects an image signal based on an input image signal. More specifically, the image signal correction unit 102 corrects the image signal through signal processing by performing the process [I] (derivation of the first correction value based on the load in the horizontal direction), the process [II] (derivation of the second correction value based on the load in the vertical direction), the process [III] (derivation of the third correction value based on the first correction value and the second correction value), and the process [IV-1] (the first correction method). A more detailed description will now be made of the structure of the image signal correction unit 102.

[Image Signal Correcting Unit 102]

Figure 13:
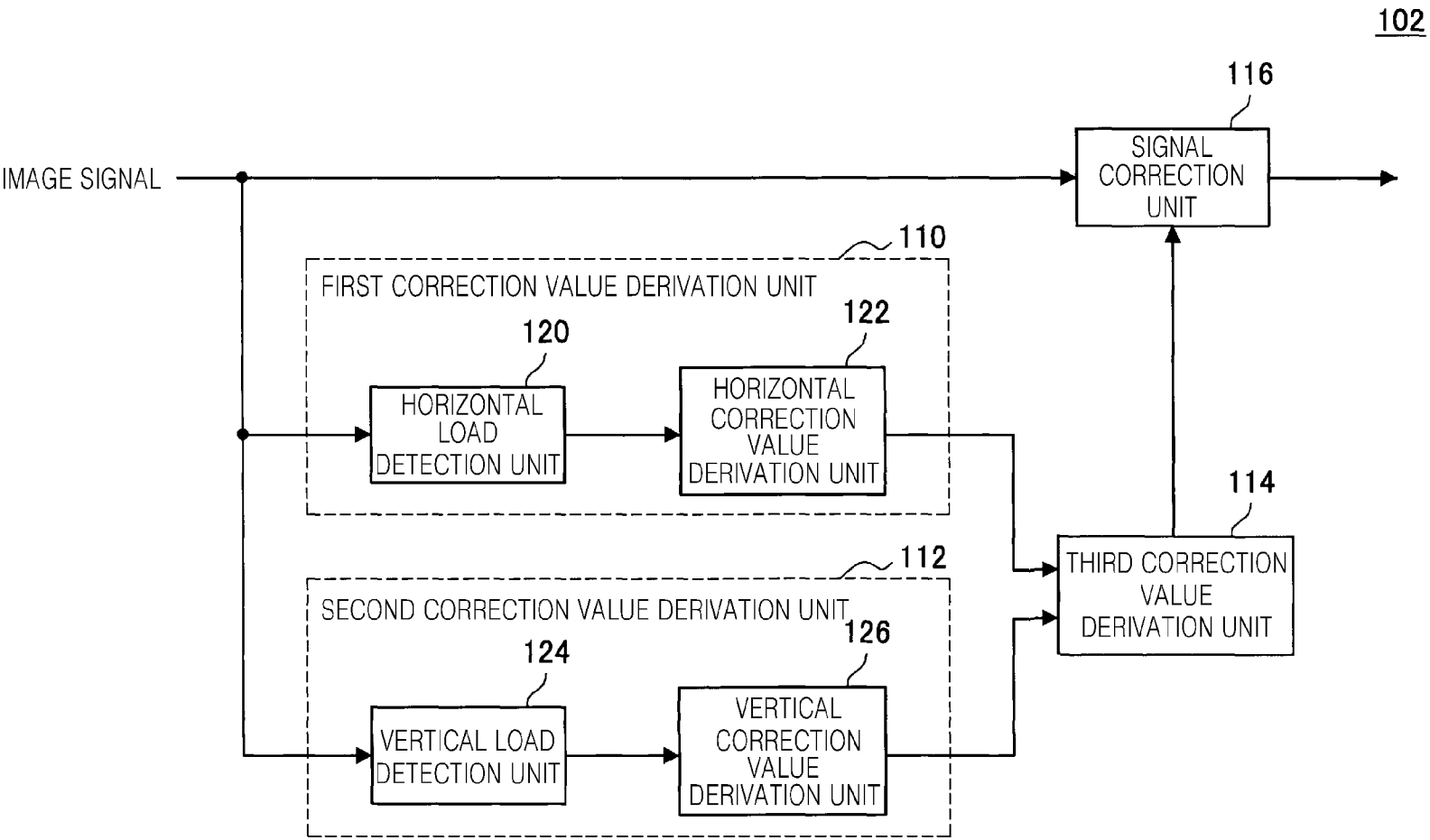
FIG. 13 is an explanatory diagram showing an example of a structure of an image signal correction unit according to an exemplary embodiment.

FIG. 13 is an explanatory diagram showing an example of the structure of the image signal correction unit 102 according to an exemplary embodiment. Referring to FIG. 13, the image signal correction unit 102 includes a first correction value derivation unit 110, a second correction value derivation unit 112, a third correction value derivation unit 114, and a signal correction unit 116. Herein, the image signal correction unit 102 may be implemented, but not limited to, in a dedicated signal processing circuit. For example, the display apparatus 100 may implement the image signal correction unit 102 in software (signal processing software) or the control unit (not shown) may serve as the image signal correction unit 102.

The first correction value derivation unit 110 includes a horizontal load detection unit 120 and a horizontal correction value derivation unit 122, and serves to perform the process [I] (derivation of the first correction value based on the load in the horizontal direction).

The horizontal load detection unit 120 serves to perform the process [I-1] and detects a load in the horizontal direction for each pixel of a line in the horizontal direction based on an input image signal. Herein, the horizontal load detection unit 120 outputs a load distribution shown in FIG. 8A or 9A as a detection result for each line based on the input image signal, but the present invention is not limited thereto.

The horizontal correction value derivation unit 122 serves to perform the process [I-2] and derives the first correction value based on the detection result obtained by the horizontal load detection unit 120.

The first correction value derivation unit 110 can derive the first correction value by including the horizontal load detection unit 120 and the horizontal correction value derivation unit 122.

The second correction value derivation unit 112 includes a vertical load detection unit 124 and a vertical correction value derivation unit 126, and serves to perform the process [II] (derivation of the second correction value based on the load in the vertical direction).

The vertical load detection unit 124 serves to perform the process [II-1] and detects a load in the vertical direction for each pixel of a line in the vertical direction based on an input image signal. Herein, the vertical load detection unit 124 outputs a load distribution shown in FIG. 10A or 11A as a detection result for each line based on the input image signal, but the present invention is not limited thereto.

The vertical correction value derivation unit 126 serves to perform the process [II-2] and derives the second correction value based on the detection result obtained by the vertical load detection unit 124.

The second correction value derivation unit 112 can derive the second correction value by including the vertical load detection unit 124 and the vertical correction value derivation unit 126.

The third correction value derivation unit 114 serves to perform the process [III] (derivation of the third correction value based on the first correction value and the second correction value), and derives the third correction value for each pixel based on the first correction value derived by the first correction derivation unit 110 and the second correction value derived by the second correction value derivation unit 112.

Figure 14:
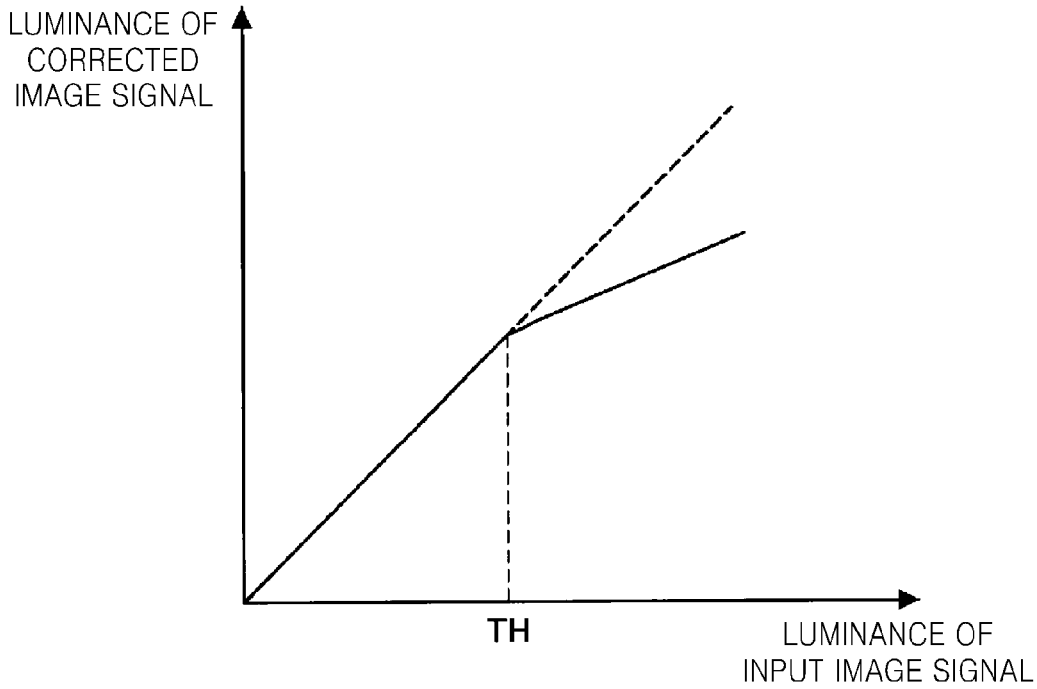
FIG. 14 is an explanatory graph for explaining another example of derivation of a third correction value in a third correction value derivation unit according to an exemplary embodiment.

Herein, although not shown in FIG. 13, the third correction value derivation unit 114 may derive the third correction value based on luminance of the input image signal. FIG. 14 is an explanatory graph for explaining another example of derivation of the third correction value in the third correction value derivation unit 114 according to an exemplary embodiment. As shown in FIG. 14, when the luminance of the input image signal is larger than a predetermined threshold TH, the third correction value derivation unit 114 sets the third correction value such that a reduction rate of the luminance of the input image signal increases in proportion to the luminance of the input image signal. Herein, since the third correction value derivation unit 114 adjusts the third correction value by using a lookup table in which luminance of an image signal and an adjustment value for the third correction value are mapped to each other, it derives the adjustment value. The third correction value derivation unit 114 may set the third correction value based on the luminance of the image signal for each pixel by performing a predetermined operation of adding the adjustment value to the third correction value obtained by using Equation 1, or multiplying the adjustment value by the third correction value obtained by using Equation 1.

The influence of the luminance change, which is described with reference to FIG. 6, is likely to be prominent in a region having high luminance. Thus, the third correction value derivation unit 114 derives the third correction value for performing non-linear correction as shown in FIG. 14, thereby reducing the luminance change which a user seeing an image displayed on a display screen may feel. Accordingly, when the third correction value derivation unit 114 derives the third correction value for performing nonlinear correction as shown in FIG. 14, a high display quality can be achieved.

The signal correction unit 116 serves to perform the process [IV-1] (the first correction method), and corrects a gain of the input image signal based on the third correction value for each pixel derived by the third correction value derivation unit 114. The signal correction unit 116 outputs the corrected image signal.

The image signal correction unit 102 may correct the image signal based on the input image signal by using the structure shown in FIG. 13.

Referring back to FIG. 12, the display unit 104 includes a display panel 130, a drive voltage supply unit 132, a scan driver 134, a data driver 136, and a display control unit 138, and displays an image represented by the image signal output from the image signal correction unit 102 on the display screen.

The display panel 130 serves as the display screen which displays the image in which pixels are arranged in the form of a p×q matrix (p and q are natural numbers greater than 2, respectively). For example, the display panel which displays an image of a standard definition (SD) resolution has at least 640×480=307,200 pixels (number of data lines×number of scan lines) and if each pixel is composed of sub-pixels of red, green, and blue for color representation, the display panel has 640×480×3=921,600 sub-pixels (number of data lines×number of scan lines×number of sub-pixel). Similarly, for example, the display panel which displays an image of a high definition (HD) resolution has 1920×1080=2,073,600 pixels and, for color representation, the display panel has 1920×1080×3=6,220,800 sub-pixels. In FIG. 12, the display panel 130 includes pixels 140*a* through 140*d* as an example.

A scan line SLm (m is an integer greater than 1) to which a scan voltage Vselect output from the scan driver 134 is applied, a data line DLn (n is an integer greater than 1) to which a data voltage Vdata (a data signal) according to an image signal output from the data driver 136 is applied, and a power supply line VLm (m is an integer greater than 1) to which a drive voltage Vcc (a drive signal) output from the drive voltage supply unit 132 is applied are connected to each of the pixels 140*a* through 140*d*. Although not shown in FIG. 12, each of the pixels 140*a* through 140*d* is connected to a common electrode (GND shown in FIG. 1).

Each of the pixels 140*a* through 140*d* may include, but not limited to, a constant-current drive structure shown in FIG. 1. For example, each of the pixels 140*a* through 140*d* may include a pixel circuit of a source follower.

The drive voltage supply unit 132 applies the drive voltage Vcc for driving each of the pixels 140*a* through 140*d* (i.e., for light emission) to each of the pixels 140*a* through 140*d* of the display panel 130 through the power supply line VLm. Herein, the drive voltage supply unit 132 selectively applies the drive voltage Vcc to the power supply line VLm based on a control signal transmitted from the display control unit 138.

The scan driver 134 applies the scan voltage Vselect for selectively applying the data voltage Vdata to each of the pixels 140*a* through 140*d* of the display panel 130 to each pixel through the scan line SLm. Herein, the scan driver 134 may selectively apply the scan voltage Vselect to the scan line SLm based on the control signal transmitted from the display control unit 138.

The data driver 136 applies the data voltage Vdata according to the image signal to each of the pixels 140*a* through 140*d* of the display panel 130 through the data line DLn. Herein, the data driver 136 may selectively apply the data voltage Vdata to the data line DLn based on the control signal transmitted from the display control unit 138. Although the image signal output from the image signal correction unit 102 is transmitted to the data driver 136 through the display control unit 138 in FIG. 12, the present invention is not limited thereto. For example, the image signal may be directly transmitted to the data driver 136 without passing through the display control unit 138.

The display control unit 138 transmits the control signal to each of the drive voltage supply unit 132, the scan driver 134, and the data driver 136, thereby controlling image display on the display screen.

The display unit 104 may display the image represented by the image signal output from the image signal correction unit 102 on the display screen through the structure shown in FIG. 12.

As such, the display apparatus 100 according to the first exemplary embodiment includes the image signal correction unit 102 for correcting the input image signal and the display unit 104 for displaying the image based on the corrected image signal. The image signal correction unit 102 corrects the image signal through signal processing by performing the process [I] (derivation of the first correction value based on the load in the horizontal direction), the process [II] (derivation of the second correction value based on the load in the vertical direction), the process [III] (derivation of the third correction value based on the first correction value and the second correction value), and the process [IV-1] (the first correction method). Herein, the image signal correction unit 102 corrects the image signal for each pixel through signal processing based on the third correction value derived based on the first correction value derived based on the load in the horizontal direction and the second correction value derived based on the load in the vertical direction. Thus, the display apparatus 100 can suppress an influence of the luminance change in each of the horizontal direction and the vertical direction, shown in FIG. 6, thereby achieving a high display quality.

[Display Apparatus 200 According to a Second Exemplary Embodiment]

In the foregoing description, the image signal is corrected through signal processing with the display apparatus 100 according to the first exemplary embodiment. However, as described in the process [IV] (correction of the image signal) of the approach to achieve a high display quality, the method of correcting the image signal according to an exemplary embodiment is not limited to signal processing. Thus, a description will be made of the display apparatus 200 according to the second exemplary embodiment for correcting the image signal by using the second correction method ([IV-2]) which is one of the foregoing examples of the approach to achieve a high display quality.

Figure 15:
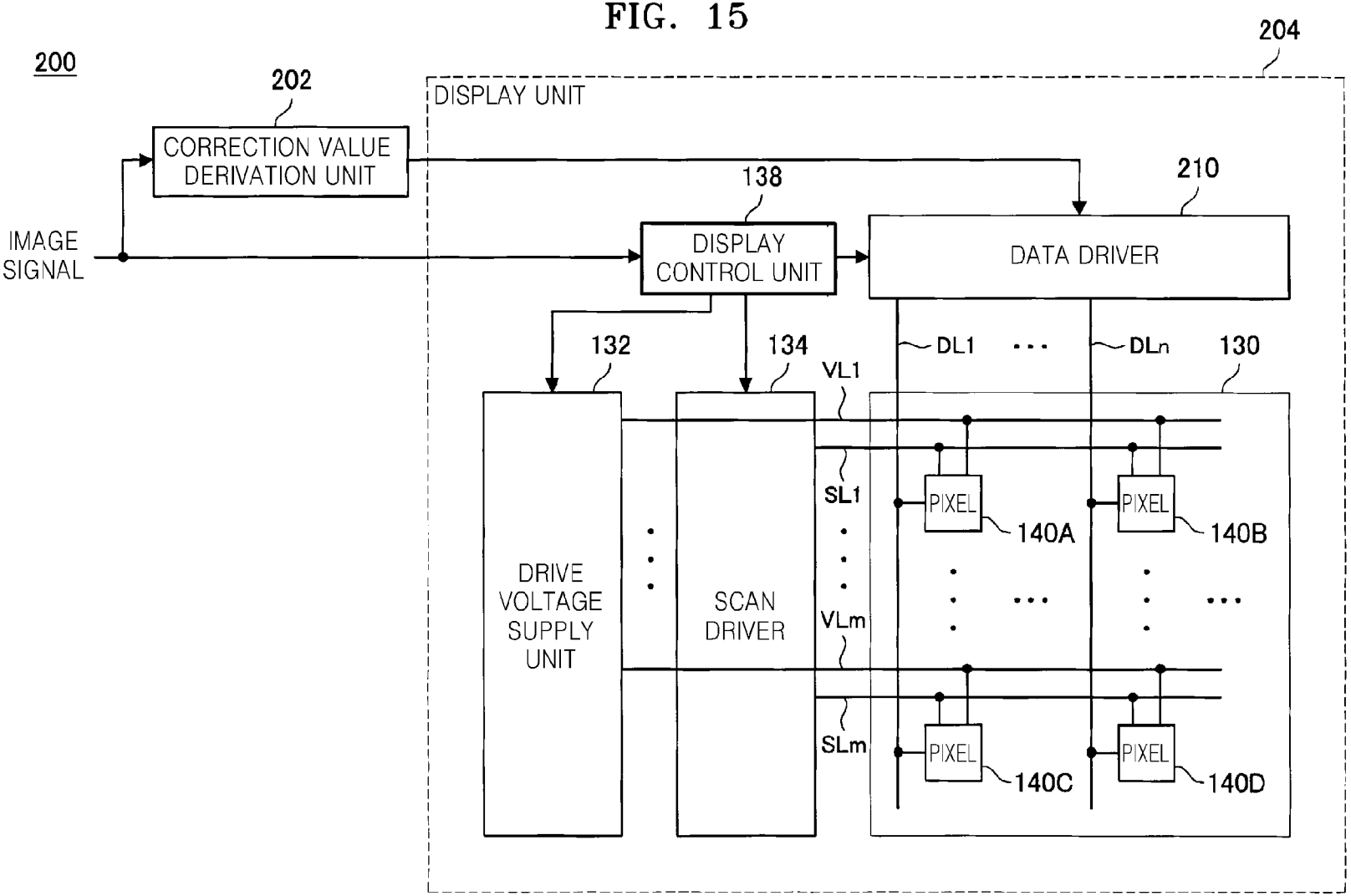
FIG. 15 is an explanatory diagram showing an apparatus for displaying an image signal according to a second exemplary embodiment.

FIG. 15 is an explanatory diagram showing the display apparatus 200 according to the second exemplary embodiment. In FIG. 15, a structure for correcting an image signal by using the second correction method described in [IV-2] which is one of the foregoing examples of the approach to achieve a high display quality is shown.

Referring to FIG. 15, the display apparatus 200 includes a correction value derivation unit 202 and a display unit 204. An exemplary embodiment is not limited to this structure, and for example, the correction value derivation unit 202 and the display unit 204 may be implemented with a separate device (i.e., an image display system).

The display apparatus 200, like the display apparatus 100 according to the first exemplary embodiment, may include a control unit (not shown) for controlling the display apparatus 200, a ROM (not shown), a RAM (not shown), a reception unit (not shown), a memory unit (not shown), a manipulation unit (not shown), and a communication unit (not shown). The display apparatus 200 may interconnect its components through a bus which is a data transmission path.

The correction value derivation unit 202 serves to derive a correction value (the third correction value) for performing the second correction method ([IV-2]) based on the input image signal. More specifically, the correction value derivation unit 202 derives the correction value for correcting the image signal by performing the process [I] (derivation of the first correction value based on the load in the horizontal direction), the process [II] (derivation of the second correction value based on the load in the vertical direction), and the process [III] (derivation of the third correction value based on the first correction value and the second correction value). Herein, the display apparatus 200 uses the correction value derived by the correction value derivation unit 202 to set an offset value which specifies conversion from the image signal into the data voltage, thus correcting the image signal without directly performing signal processing on the image signal, unlike in the display apparatus 100 according to the first exemplary embodiment. Hereinafter, the structure of the correction value derivation unit 202 will be described in more detail.

[Correction Value Derivation Unit 202]

Figure 16:
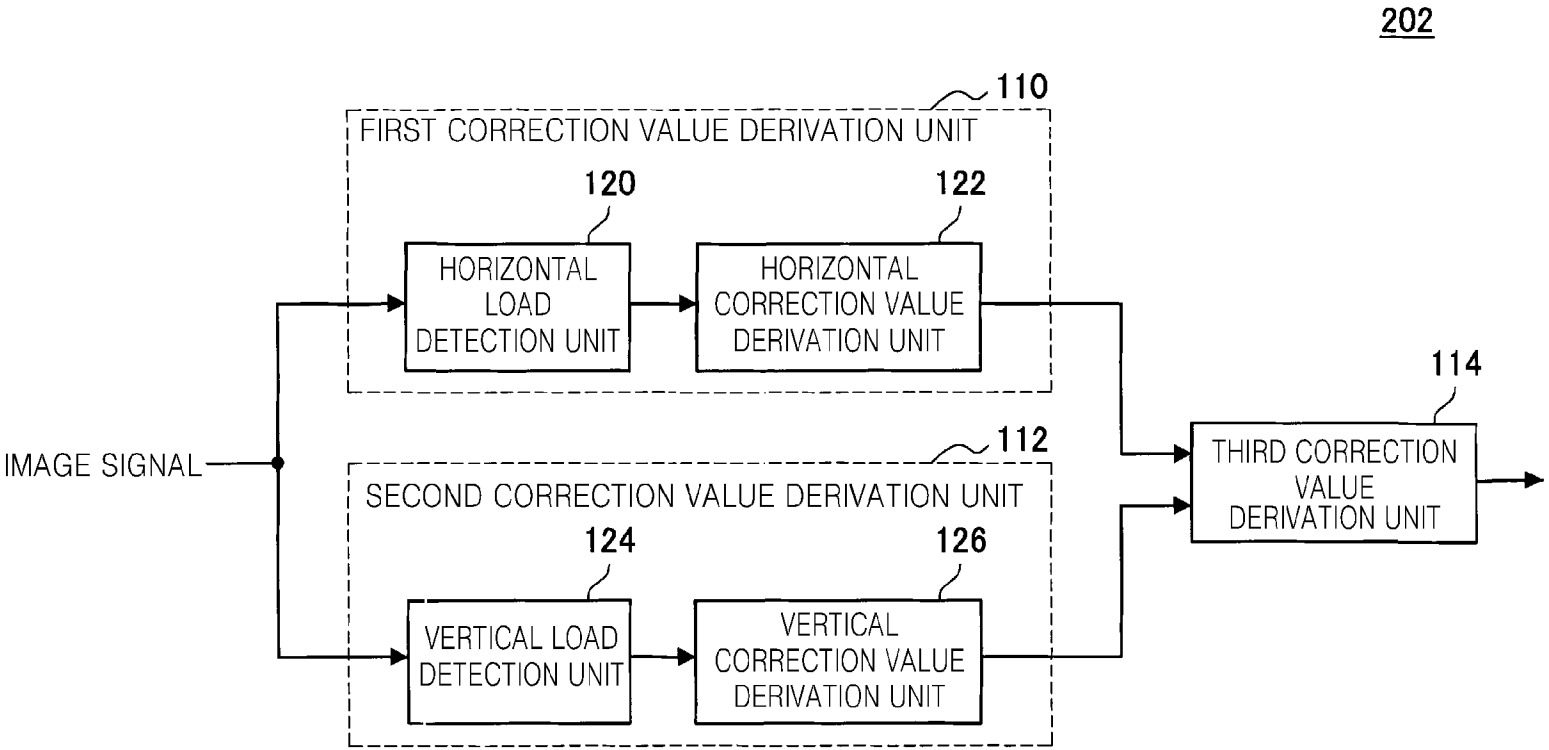
FIG. 16 is an explanatory diagram showing an example of a structure of a correction value derivation unit according to an exemplary embodiment.

FIG. 16 is an explanatory diagram showing an example of the structure of the correction value derivation unit 202 according to an exemplary embodiment. Referring to FIG. 16, the correction value derivation unit 202 includes the first correction value derivation unit 110, the second correction value derivation unit 112, and the third correction value derivation unit 114. Herein, the correction value derivation unit 202 may be implemented, but not limited to, in a dedicated signal processing circuit. For example, the display apparatus 200 may implement the correction value derivation unit 202 in software (signal processing software) or the control unit (not shown) may serve as the correction value derivation unit 202.

The first correction value derivation unit 110, the second correction value derivation unit 112, and the third correction value derivation unit 114 have the same functions and structures as those of the first correction value derivation unit 110, the second correction value derivation unit 112, and the third correction value derivation unit 114 according to the first exemplary embodiment shown in FIG. 13. Thus, the correction value derivation unit 202, like the image signal correction unit 102 according to the first exemplary embodiment shown in FIG. 13, may derive the correction value (the third correction value) based on the first correction value derived based on the load in the horizontal direction and the second correction value derived based on the load in the vertical direction.

The correction value derivation unit 202 may derive the correction value (the third correction value) for correcting the image signal for each pixel with the above-described structure.

Referring back to FIG. 15, the display unit 204 includes the display panel 130, the drive voltage supply unit 132, the scan driver 134, a data driver 210, and the display control unit 138. The display unit 204 corrects the input image signal based on the correction value for each pixel, transmitted from the correction value derivation unit 202, and displays an image represented by the corrected image signal on the display screen.

The display panel 130, the drive voltage supply unit 132, the scan driver 134, and the display control unit 138 have the same functions and structures as the display panel 130, the drive voltage supply unit 132, the scan driver 134, and the display control unit 138 according to the first exemplary embodiment shown in FIG. 12.

The data driver 210 serves to perform the process [IV-2] (the second correction method) and corrects the image signal based on the correction value for each pixel, transmitted from the correction value derivation unit 202, and the input image signal. The data driver 210 corrects the image signal by using the received correction value as an offset value to be applied to a D/A converter which converts the image signal into the data voltage Vdata. The data driver 210 directly performs signal processing on the image signal, and thus, does not perform a correction operation that the image signal correction unit 102 performs according to the first exemplary embodiment. However, the data driver 210 changes the offset value which specifies conversion from the image signal into the data voltage Vdata according to the correction value and applies the data voltage Vdata corrected with the correction value to each pixel, thus providing the same effect as correction of the image signal based on signal processing.

The display unit 204 may correct the input image signal based on the correction value for each pixel, transmitted from the correction value derivation unit 202, and displays an image represented by the corrected image signal on the display screen with the above-described structure.

As such, the display apparatus 200 according to the second exemplary embodiment includes correction value derivation unit 202 for deriving the correction value for each pixel based on the input image signal and the display unit 204 for correcting the image signal based on the derived correction value and displaying an image represented by the corrected image signal on the display screen. The correction value derivation unit 202 derives the correction value for each pixel by performing the process [I] (derivation of the first correction value based on the load in the horizontal direction), the process [II] (derivation of the second correction value based on the load in the vertical direction), and the process [III] (derivation of the third correction value based on the first correction value and the second correction value). Herein, the correction value derivation unit 202 derives the correction value (the third correction value) based on the first correction value derived based on the load in the horizontal direction and the second correction value derived based on the load in the vertical direction. The display unit 204 corrects the image signal by performing the process [IV-2] (the second correction method). Herein, the display unit 204 changes the offset value, which specifies conversion from the image signal into the data voltage Vdata, according to the correction value to correct the image signal. Thus, the display unit 204 can apply the data voltage Vdata corrected by the correction value to each pixel, thereby providing the same effect as correction of the image signal based on signal processing according to the first exemplary embodiment. Thus, the display apparatus 200 can suppress an influence of the luminance change in each of the horizontal direction and the vertical direction, shown in FIG. 6, thereby achieving a high display quality.

The display apparatus according an exemplary embodiment detects the load in each of the horizontal direction and the vertical direction of the display screen based on the input image signal with the structure of the display apparatus 100 according to the first exemplary embodiment or the structure of the display apparatus 200 according to the second exemplary embodiment, thereby achieving a high display quality.

Although the display apparatus 100 and the display apparatus 200 have been described as exemplary embodiments, the present invention is not limited thereto. For example, the present invention may be applied to various devices such as a display device, like an organic EL display, an LCD, or a PDP, in which pixels are arranged in a matrix form, a reception device for receiving television broadcasting, a portable communication device, like a computer or a cell phone, having an internal or external display means.

(Program for Display Apparatus According to an Exemplary Embodiment)

By using a program for allowing a computer to function as the display apparatus 100 according to the first exemplary embodiment, a load in each of a horizontal direction and a vertical direction of a display screen may be detected based on an input image signal, thereby achieving a high display quality. More specifically, the program may allow a computer to function as the image signal correction unit 102.

(Method of Correcting an Image Signal According to an Exemplary Embodiment)

Figure 17:
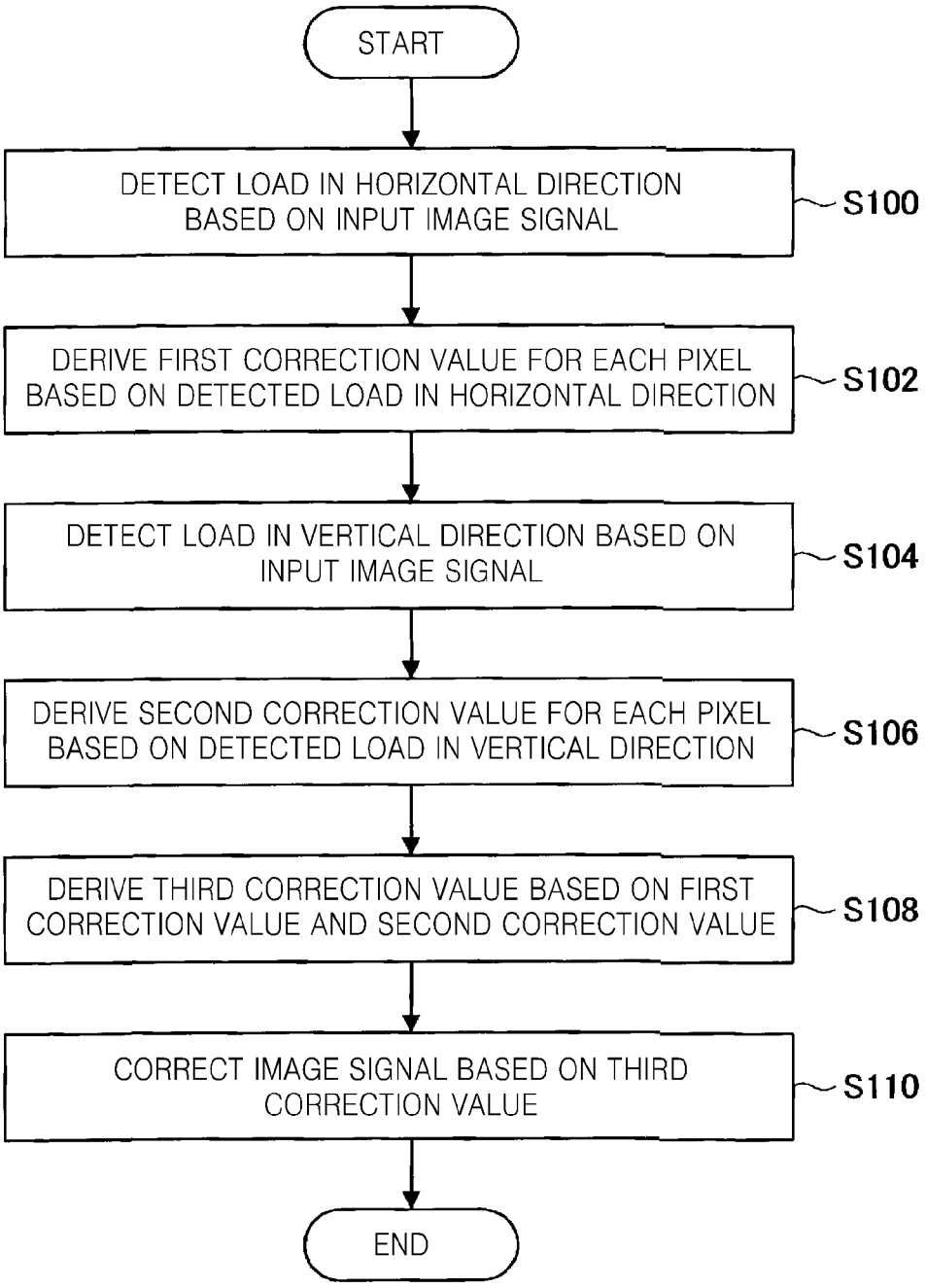
FIG. 17 is a flowchart showing an example of a method of correcting an image signal according to an exemplary embodiment.

Next, a description will be made of a method of correcting an image according to an exemplary embodiment. FIG. 17 is a flowchart showing an example of the method of correcting an image signal according to an exemplary embodiment. In the following description, the method is performed by the display apparatus.

The display apparatus detects a load in a horizontal direction based on an input image signal in operation S100. Herein, the display apparatus may detect a load distribution shown in FIG. 8A or 9A as a detection result for each line, but the present invention is not limited thereto.

Once the load in the horizontal direction is detected in operation S100, the display apparatus derives a first correction value for each pixel based on the detected load in the horizontal direction in operation S102. Herein, the display apparatus derives the first correction value for each pixel according to the input image signal by using a lookup table in which a signal level of an image signal and a first correction value are mapped to each other.

The display apparatus detects the load in the vertical direction based on the input image signal in operation S104. Herein, the display apparatus may output a load distribution shown in FIG. 10A or 11A as a detection result for each line, but the present invention is not limited thereto.

Once the load in the vertical direction is detected in operation S104, the display apparatus derives a second correction value for each pixel based on the detected load in the vertical direction in operation S106. Herein, the display apparatus may derive the second correction value for each pixel according to the input image signal by using a lookup table in which a signal level of an image signal and a second correction value are mapped to each other, like in operation S102.

Although operations S104 and S106 are performed after S100 and S102 in FIG. 17, operations S100 and S102 and operations S104 and S106 may be performed in dependently. Thus, the display apparatus may synchronize operations S100 and S102 with operations S104 and S106 or may perform operations S100 and S102 after operations S104 and S106.

Once the first correction value and the second correction value are derived in operations S102 and S106, respectively, the display apparatus derives a third correction value for each pixel based on the first correction value and the second correction value in operation S108. Herein, the display apparatus derives the third correction value by using Equation 1, but the present invention is not limited thereto.

Once the third correction value is derived in operation S108, the display apparatus corrects the image signal based on the third correction value in operation S110. Herein, the display apparatus may correct the image signal by adjusting a gain of the input image signal based on the third correction value through signal processing (like in the display apparatus 100 according to the first exemplary embodiment), but the present invention is not limited thereto.

For example, the display apparatus may correct the image signal by changing an offset value, which specifies conversion from the image signal into the data voltage Vdata, based on the third correction value, without using signal processing (like in the display apparatus 200 according to the second exemplary embodiment).

The display apparatus may detect the load in each of the horizontal direction and the vertical direction based on the input image signal by using the method shown in FIG. 17, thereby achieving a high display quality.

While the exemplary embodiments have been illustrated in detail, the present invention is not limited to those exemplary embodiments. It is apparent that various modifications and adaptations can be conceived by those of ordinary skill in the art without departing from the scope of the present invention as set forth in the following claims and are considered to be within the scope of the present invention.

For example, although it is described that an image signal input to the display apparatus according to an exemplary embodiment is a digital signal, but the input image signal is not limited to the digital signal. For example, a display apparatus according to an exemplary embodiment may include an analog-to-digital (A/D) converter to convert an input analog signal (an image signal) into a digital signal and then process the converted image signal. The display apparatus according to an exemplary embodiment may process the analog signal (the image signal) by constituting each of its components as an analog circuit.

The above-described structure is only an example of the present invention, and is considered to be within the technical scope of the present invention.

The present invention can be embodied as computer-readable code on a computer-readable recording medium. The computer-readable recording medium is a data storage device that can store data which can be thereafter read by a computer system. Examples of computer-readable recording media include a read-only memory (ROM), a random-access memory (RAM), CD-ROMs, magnetic tapes, floppy disks, optical data storage devices. The computer-readable recording medium can also be distributed over a network of coupled computer systems so that the computer-readable code is stored and executed in a decentralized fashion.

According to the present invention, a high display quality can be achieved by detecting the load in each of the horizontal direction and the vertical direction of the display screen based on the input image signal.

While the present invention has been particularly shown and described with reference to exemplary embodiments thereof, it will be understood by those of ordinary skill in the art that various changes in form and details may be made therein without departing from the essential features of the present invention. Accordingly, the scope of the present invention should be construed to include various embodiments within a scope equivalent to the appended claims, without being limited to the disclosed exemplary embodiments.

What is claimed is:

1. An apparatus for processing an image signal, the apparatus comprising:

a first correction value derivation unit which outputs a first correction value for correcting an input image signal for each pixel of a line in a horizontal direction of a display screen, based on the input image signal;

a second correction value derivation unit which outputs a second correction value for correcting the input image signal for each pixel of a line in a vertical direction of the display screen, based on the input image signal;

a third correction value derivation unit which outputs a third correction value for correcting the input image signal for each pixel of the display screen which displays an image corresponding to the input image signal, based on the first correction value and the second correction value; and a correction unit which corrects the input image signal based on the third correction value, wherein the first correction value derivation unit outputs the first correction value based on a load for each pixel of the line in the horizontal direction of the display screen.

2. The apparatus of claim 1, wherein the first correction value derivation unit comprises:

a horizontal load detection unit which detects the load for each pixel of the line in the horizontal direction, based on the input image signal; and a horizontal correction value derivation unit which outputs the first correction value, based on a result of the detection performed by the horizontal load detection unit.

3. The apparatus of claim 2, wherein the second correction value derivation unit comprises:

a vertical load detection unit which detects a load for each pixel of the line in the vertical direction, based on the input image signal; and a vertical correction value derivation unit which outputs the second correction value, based on a result of the detection performed by the vertical load detection unit.

4. The apparatus of claim 3, wherein the third correction value derivation unit outputs the third correction value by multiplying the first correction value by the second correction value.

5. The method of claim 2, wherein the third correction value derivation unit outputs the third correction value by multiplying the first correction value by the second correction value.

6. The apparatus of claim 1, wherein the second correction value derivation unit comprises:

a vertical load detection unit which detects a load at each pixel of the line in the vertical direction, based on the input image signal; and a vertical correction value derivation unit which outputs the second correction value, based on a result of the detection performed by the vertical load detection unit.

7. The apparatus of claim 1, wherein the third correction value derivation unit outputs the third correction value by multiplying the first correction value by the second correction value.

8. An apparatus for displaying an image signal, the apparatus comprising:

the apparatus of claim 1, which corrects the input image signal to generate a corrected image signal; and an image display unit comprising a plurality of pixels arranged in a matrix form, the image display unit displaying an image based on the corrected image signal.

9. The apparatus of claim 8, wherein the image display unit changes an offset value, which specifies conversion from the input image signal into a data voltage applied to each of the pixels, on a basis of the third correction value based on the input image signal, and displays an image based on the corrected image signal on the display screen.

10. A non-transitory computer readable recording medium having embodied thereon a computer program for executing a method of processing an image signal, the method comprising:

obtaining a first correction value for correcting an input image signal for each pixel of a line in a horizontal direction of a display screen, based on an input image signal;

obtaining a second correction value for correcting the input image signal for each pixel of a line in a vertical direction of the display screen, based on the input image signal;

obtaining a third correction value for correcting the input image signal for each pixel of the display screen which displays an image corresponding to the input image signal, based on the first correction value and the second correction value; and correcting the input image signal based on the third correction value, wherein the obtaining the first correction value is performed based on a load for each pixel of the line in the horizontal direction of the display screen.

* * * * *